US005961023A

United States Patent [19]

Mattila

[11] Patent Number: 5,961,023

[45] Date of Patent: Oct. 5, 1999

[54] FILM TRANSPORT ROLLER ASSEMBLY

[75] Inventor: Robert J. Mattila, Woodbury, Minn.

[73] Assignee: Imation Corp., Oakdale, Minn.

[21] Appl. No.: 08/939,571

[22] Filed: Sep. 29, 1997

[51] Int. Cl.[6] ..... B65H 20/00; B65H 57/14

[52] U.S. Cl. ..... 226/187; 226/194; 242/615.2; 242/615.4

[58] Field of Search ..... 226/181, 186, 226/187, 194; 242/615.2, 615.4

[56] References Cited

U.S. PATENT DOCUMENTS

| | | | |
|---|---|---|---|
| 1,142,442 | 6/1915 | Krauth | 226/187 X |
| 2,513,093 | 6/1950 | Hageman | 226/187 X |
| 3,107,064 | 10/1963 | Price et al. | 226/187 X |
| 3,297,223 | 1/1967 | Bueker | 226/187 X |
| 3,799,422 | 3/1974 | Matsumoto | 242/615.4 |
| 3,807,616 | 4/1974 | Hope et al. | 226/194 |
| 4,158,429 | 6/1979 | Ohmori | 226/186 X |
| 4,745,508 | 5/1988 | Tollefson | 242/615.4 X |
| 4,934,577 | 6/1990 | Sugimoto et al. | 242/615.4 |
| 5,420,678 | 5/1995 | Rasch et al. | 226/187 X |

*Primary Examiner*—Michael R. Mansen
*Attorney, Agent, or Firm*—Dicke, Billig & Czaja, P.A.

[57] ABSTRACT

A transport roller assembly for moving film along a film transport path between a pair of rigid plates in an imaging system. The rollers are preassembled in the bearing block assemblies and the assemblies are installed in the system by sliding them into receiving slots in the plates. The roller surface and the bearing block assembly are constructed from static dissipating materials to remove static from the surface of the film as it is transported.

34 Claims, 5 Drawing Sheets

FILM TRANSPORT ROLLER ASSEMBLY

FIELD OF THE INVENTION

The present invention relates generally to optical scanner systems and laser imaging systems incorporating such scanners. In particular the present invention relates to a roller assembly for transporting film within a laser imaging system.

BACKGROUND OF THE INVENTION

Laser imaging systems are commonly used to produce photographic images from digital image data generated by magnetic resonance (MR), computed tomography (CT) or other types of scanners. Systems of this type typically include a continuous tone laser imager for exposing the image on photosensitive film, a film processor for developing the film, and an image management subsystem for coordinating the operation of the laser imager and the film processor.

The digital image data is a sequence of digital image values representative of the scanned image. Image processing electronics within the image management subsystem process the image data values to generate a sequence of digital laser drive values (i.e. exposure values), which are input to the laser scanner. The laser scanner is responsive to the digital laser drive values for scanning across the photosensitive film in a raster pattern for exposing the image on the film.

The continuous tone images used in the medical imaging field have very stringent image-quality requirements. A laser imager printing onto transparency film exposes an image in a raster format, the line spacing of which must be controlled to better than one micrometer. In addition the image must be uniformly exposed such that the observer cannot notice any artifacts. In the case of medical imaging, the observers are image analysts (e.g., radiologists).

In order to attain image quality of the required degree, it is important that all of the elements of the imager system handle the sheet of photosensitive film smoothly and efficiently without doing anything to degrade the images that ultimately appear on the film. The film is moved between the various stages of the exposure and development process using roller pairs that engage the sheet in their nip and drive it along a film transfer or transport path.

In conventional imaging apparatus, film transport rollers are mounted on bearing assemblies attached to frame side plates on both sides of the film transfer path that must be moved in order to install the rollers. The roller shafts extend through the side plates, which may be part of the imaging apparatus frame, making it very difficult to remove a roller or perform maintenance thereon, once they have been installed. Particularly where multiple film transport roller paths are used, it may be very difficult to manipulate the plates to install multiple rollers in premounted bearing sets. Further, in the imaging system it is also a continuing concern that static electricity build up on the film be managed because of the potential for the build up of static electricity to cause artifacts or a degraded image on the film, or cause the sheets of film to stick to the rollers.

It is desirable to have a film drive roller assembly for use in an imaging system that may be installed between two rigid plates as a preassembled assembly and does not require movement of the plates to install the rollers into their bearing sets. Further, it is also desirable to manage static electricity build-up on transported sheet material by providing static electricity dissipation characteristics for the rollers and bearings so that static electricity is dissipated to the frame of the imaging system from the surface of the film.

SUMMARY OF THE INVENTION

The present invention relates generally to several specific aspects of providing a preassembled drive roller assembly for use in an imaging system.

It is an object of the present invention to provide a preassembled drive roller system for installation in an imaging system without the necessity of removing plates of the machine to install bearings and rollers.

In one exemplary embodiment, the present invention provides a film transport roller assembly for use in a laser imaging system for transporting a piece of photosensitive film along a film transport path. The film transport roller assembly includes a first and second bearing block assembly, a first roller, and a second roller. The first roller and the second roller are rotatably coupled in a nip position between the first and second bearing block assembly. The first and second bearing block assembly each comprise a slider block, a bearing block, wherein the bearing block includes a slider block receiving aperture, and wherein the slider block is slidably positioned within the bearing block, and a biasing mechanism coupled between the slider block and the bearing block which biases the slider block against the bearing block.

A gripping mechanism extends from the slider block to aid an operator in gripping the slider block and moving the slider block in a direction away from the bearing block. The gripping mechanism may include a thumb tab and an extension tab. The gripping mechanism may define a biasing mechanism channel.

The bearing block may further include a pair of mounting channels, allowing the slider block assembly to be slidably received within an imaging system frame. The bearing block may further include a biasing mechanism mounting post, and wherein the slider block comprises a biasing mechanism mounting channel. The biasing mechanism mounting channel may extend at least partially along the outside perimeter of the slider block.

In one application, the first roller is rotatably mounted to the slider block and the bearing block, and the second roller is rotatably mounted to the bearing block. The bearing block assembly may further include a stop mechanism for limiting the degree of movement between the slider block and the bearing block.

The bearing block assembly is made of a polymeric material. Further, the bearing block assembly may be made of a material sufficiently conductive to allow the dissipation of static electricity therethrough. In one embodiment, the bearing block assembly is made of a polymeric material having a static dissipation additive mixed therein. The first roller and the second roller are made of a material sufficiently conductive to allow the dissipation of static electricity therethrough. In one embodiment, the first roller and the second roller each comprise a generally elongate metallic shaft having a film engaging coating thereon. The metallic shaft can be made of stainless steel. The film engaging coating is made of a polymeric material. In one preferred embodiment, the polymeric material is an elastomeric urethane. The polymeric material may include a static dissipating additive.

Another exemplary embodiment of a system in accordance with the present invention provides an imaging system wherein a sheet of film is transported within the system by at least one driven roller assembly having cooperating roller pairs positioned between a pair of opposed rigid plates, each of the roller assemblies being mounted on the plates by sliding the preassembled roller assembly into bearing block receiving slots in the plates.

A further embodiment of a film transport assembly for installation in mounting slots in a pair of rigid plates in an imaging system in accordance with the present invention includes a pair of bearing slide members, each of the bearing slide members having a shaft receiving aperture therethrough surrounded by a shaft supporting surface. A pair of bearing blocks is also included where each of the bearing blocks may be characterized as having a shaft receiving aperture through a face thereof with a shaft supporting surface surrounding the aperture. The bearing block also may be characterized as having a bearing slide engaging area adjacent the aperture, and where the bearing block also has a circumferential slot projecting into the walls thereof which is constructed and arranged for engagement with one of the mounting slots in one of the rigid plates for securing the bearing block to the plate. The assembly also includes a first roller having a film engaging surface covering a central roller portion thereof and shaft portions extending from both ends of the central portion with each of the shaft portions being constructed and arranged for rotation in the shaft receiving aperture of one of the pair of bearing blocks. The assembly also includes a second roller having a film engaging surface covering a central roller portion thereof and shaft portions extending from both ends of the central roller portion each of which is constructed and arranged for rotation in a shaft receiving aperture supported by the shaft supporting surface in one of the pair of bearing slides with each of the bearing slides and the shaft portion journalled therein being positioned relative to the shaft receiving apertures such that the bearing slide and second roller are movable on the bearing slide receiving area of the bearing blocks such that the film engaging surface of the second roller can be moved out of engagement with the film engaging surface of the first roller when the bearing slide member is moved toward a first position on the bearing slide receiving area of the bearing block and into contact with the film engaging surface of the other roller when the bearing slide member is moved away from that position. Finally, the assembly also includes spring means operatively connected between the bearing slide and the bearing block for biasing the film engaging surface of the second roller into film transporting contact with the first roller when one of the first or second rollers is driven to transport film along a film transport path normal to the axes of the shafts of the first and second rollers.

The advantages of the present invention will be set forth in part in the description that follows and in part will be apparent from the description or may be learned by practice of the invention. The advantages of the present invention will be realized and attained by means particularly pointed out in the written description and claims, as well as in the appended drawings. It is to be understood, however, that both the foregoing general description and the following detailed description are exemplary and explanatory only, and not restrictive of the present invention, as claimed.

BRIEF DESCRIPTION OF THE DRAWINGS

The accompanying drawings are included to provide a further understanding of the present invention and are incorporated and constitute a part of this specification. The drawings illustrate the exemplary embodiments of the present invention and together with the description, serve to explain the principles of the invention. Other objects of the present invention, and many of the intended advantages of the present invention, will be readily appreciated as the same becomes better understood by reference to the following detailed description, which, when considered in connection with the accompanying drawings, in which like reference numerals designate like or similar parts throughout the drawing figures and wherein.

DETAILED DESCRIPTION OF THE INVENTION

Figure 1:
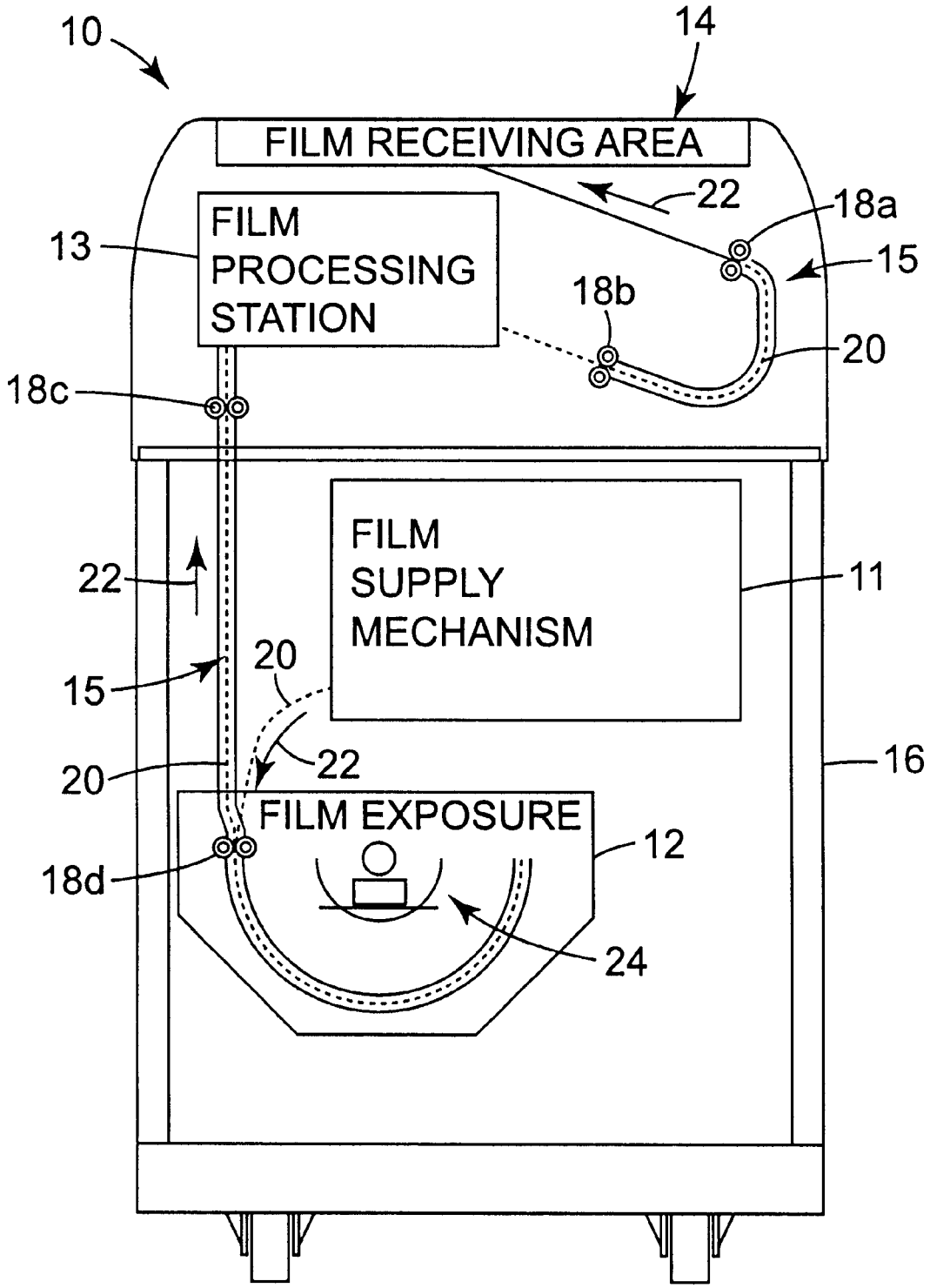
FIG. 1 is an elevational diagram of a laser imaging apparatus having a film roller assembly in accordance with the present invention.

FIG. 1 is an elevational diagram illustrating an exemplary embodiment of a laser imaging system 10 suitable for use in the medical imaging industry, including a film transport roller assembly, in accordance with the present invention. The imaging system 10 includes a film supply mechanism 11, a film exposure assembly 12, a film processing station 13, a film receiving area 14, and a film transport system 15. The film supply mechanism 11, film exposure assembly 12, film processing station 13, and film transport system 15 are all located within imaging system housing 16.

Photosensitive film is stored within the film supply mechanism 11. The film transport system 15 allows the photosensitive film to be moved between the film exposure assembly 12, film processing station 13, and the film receiving area 14. The film transport system 15 includes a film transport roller assemblies 18 (indicated as 18*a*, 18*b*, 18*c* and 18*d*) to aid in transporting the film along a film transport path, indicated by dashed line 20. The direction of film transported along film transport path 20 is indicated by arrows 22. As shown in the exemplary embodiment of FIG. 1, in a typical imaging system 10, there may be several film transport roller assemblies 18 (18*a*, 18*b*, 18*c*, and 18*d*) used to transport film along different film transport paths 20 or along an elongated film transport path 20.

In the exemplary embodiment shown, the film supply mechanism 11 includes a mechanism (not shown) for feeding a piece of film along film transport path 20 into the film exposure assembly 12 for exposing the desired image on the photosensitive film using an optical or laser scanner assembly 24. After exposure of the desired image on the photosensitive film, the photosensitive film is moved along the film transport path 20 by film transport roller assemblies 18 to the film processing station 13. The film processing station 13 develops the image on the photosensitive film. After film development, the photosensitive film is transported to the film receiving area 14. One film supply and pickup mechanism suitable for use in a laser imaging system in accordance with the present invention is as disclosed in U.S. patent application Ser. No. 08/939,510, filed on Sep. 29, 1997, the entire contents of which are incorporated herein by reference. One suitable film processing station is as disclosed in U.S. patent application Ser. No. 08/940,091, filed Sep. 29, 1997, and U.S. patent application Ser. No. 08/239,709, filed on May 9, 1994, the entire contents of which are incorporated herein by reference.

In the exemplary embodiment shown, the film exposure assembly 12 has an internal-drum configuration. The film exposure assembly 12 includes the optical or laser scanner assembly 24 mechanically coupled to a linear translation system (not shown). During a scanning process, the optics linear translation system operates to move the optical scanner assembly 24 along a longitudinal axis of the drum (in a direction generally perpendicular to the scanning direction), and after scanning, returns the optical scanner assembly 24 to a start position, along the longitudinal axis of the drum. One suitable linear translation system for moving an optical scanner assembly, in accordance with the present invention, which minimizes velocity variations in the system allowing "continuous scan" or "continuous step-scan" laser scanning operation is as shown in U.S. patent application Ser. No. 08/939,420, filed on Sep. 29, 1997, as manufactured by Imation Corp., the entire contents of which are incorporated herein by reference. One suitable method for feeding, centering and aligning a photosensitive film within a drum for use with an exposure assembly in accordance with the present invention is as disclosed in U.S. patent application Ser. No. 08/939,365, filed on Sep. 29, 1997 the entire contents of which are incorporated herein by reference.

In one exemplary embodiment, the film exposure area on the internal surface of the drum is 17" by 14", suitable for exposure of a 17" by 14" piece of photosensitive film. In one exemplary embodiment, the film is exposed in a vertical direction. In particular, since the film is fed into the exposure module in the 14" direction, and subsequently scanned in the 17" direction, the scanned raster lines appear in the vertical direction. The laser beam is scanned 180° (or greater than 180°) across the internal drum surface, for exposure of 17" across the photosensitive film. The linear translation system moves the optical scanner assembly along the longitudinal axis located at the center of curvature of the internal drum surface for a distance of 14", for full exposure of a desired image/images on the photosensitive film.

The photosensitive film can be a photosensitive film which is sensitive to laser beam light. In one exemplary embodiment, the film is a light sensitive photothermographic film having a polymer or paper base coated with an emulsion of dry silver or other heat sensitive material. One known film suitable for use in medical imaging processes with a film exposure system having film transport roller assemblies in accordance with the present invention is commercially available under the trade name DRYVIEW IMAGING FILM (DVB or DVC) manufactured by Imation Corp. of Oakdale, Minn.

Figure 2:
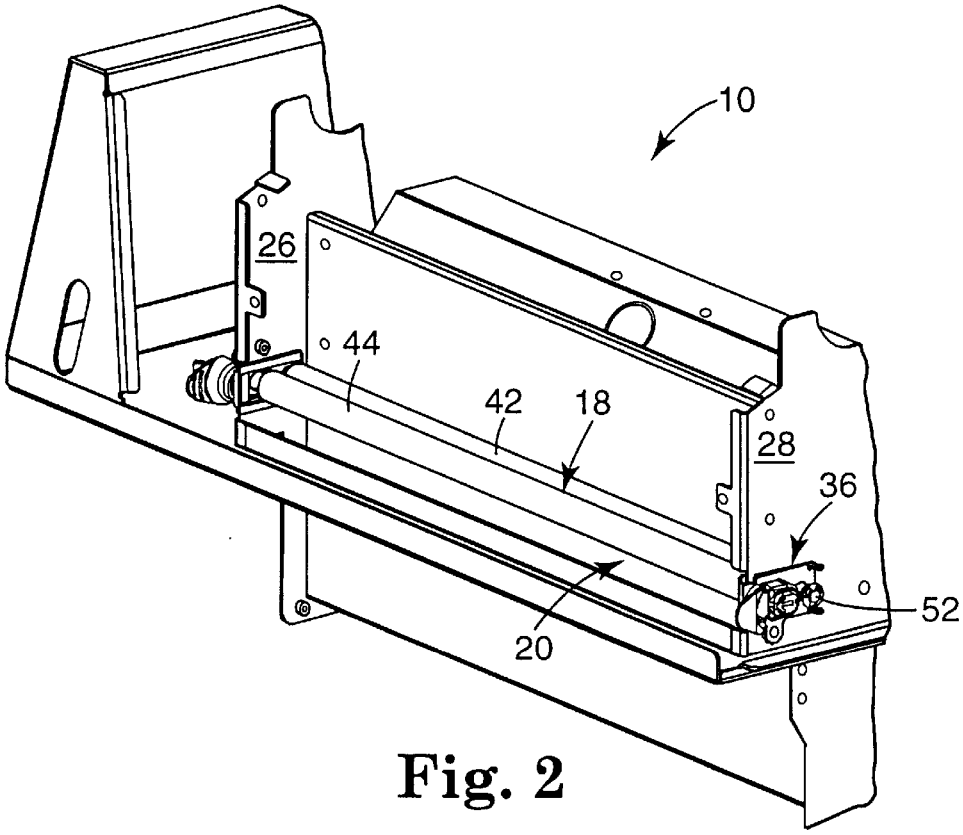
FIG. 2 is a fragmentary perspective view of an exemplary imaging system having a film roller assembly in accordance with the present invention.

Referring to FIG. 2, a fragmentary perspective view illustrating one exemplary embodiment of an imaging system having a film transport roller assembly in accordance with the present invention is generally shown.

Figure 3:
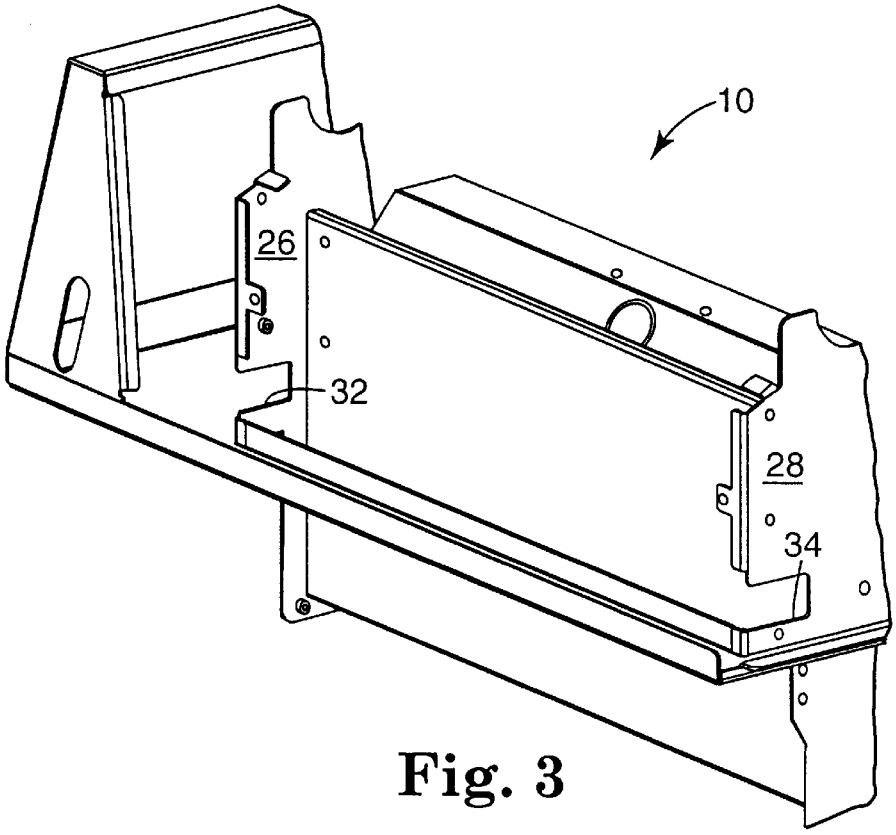
FIG. 3 is a perspective view of the portion of the imaging system shown in FIG. 2 with the film roller assembly removed.

As shown in the exemplary embodiment of FIG. 2, each end of film transport roller assembly 18 is mounted on one of a pair of rigid plates 26, 28 that are positioned within imaging system 10 on both sides of a film transport path 20. As can be best seen in FIG. 3, a pair of mounting slots 32, 34 are provided in rigid plates 26 and 28 respectively for receiving roller assembly 18. Mounting slots 32, 34 are sized and shaped for slidable receipt of film transport roller assembly 18. Rigid plates 26, 28 may be part of the imaging system housing 16 frame.

Mounting slots 32, 34 are illustrated as having an essentially rectangular perimeter shape, although there are many possible variations in their geometry consistent with their ability to receive an assembled film transfer roller assembly 18 as it is slid into the mounting slots 32, 34.

Figure 4:
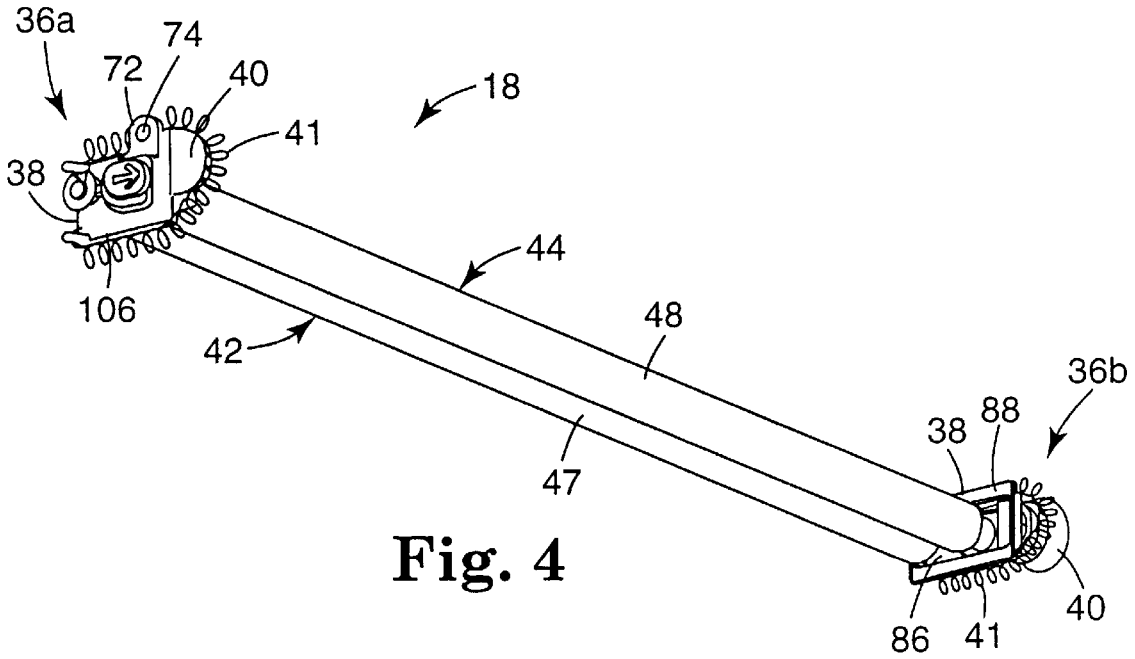
FIG. 4 is a perspective view of one exemplary embodiment of a preassembled film roller assembly in accordance with the present invention ready for installation between a pair of plates in an imaging system.

Referring to FIG. 4, a perspective view of the elements of a film transfer roller assembly in accordance with the present invention, indicated as film transfer roller assembly 18, are shown. Drive roller assembly 18 has a bearing block assembly 36 on either end (indicated as 36*a*, 36*b*) thereof for engagement with mounting slots 32, 34 of plates 26, 28. Bearing block assembly 36 is, in turn, comprised of a bearing block 38, a bearing slide member 40, and a biasing mechanism 41 (e.g., a spring as shown) which are individually illustrated and discussed in further detail below.

Figure 5:
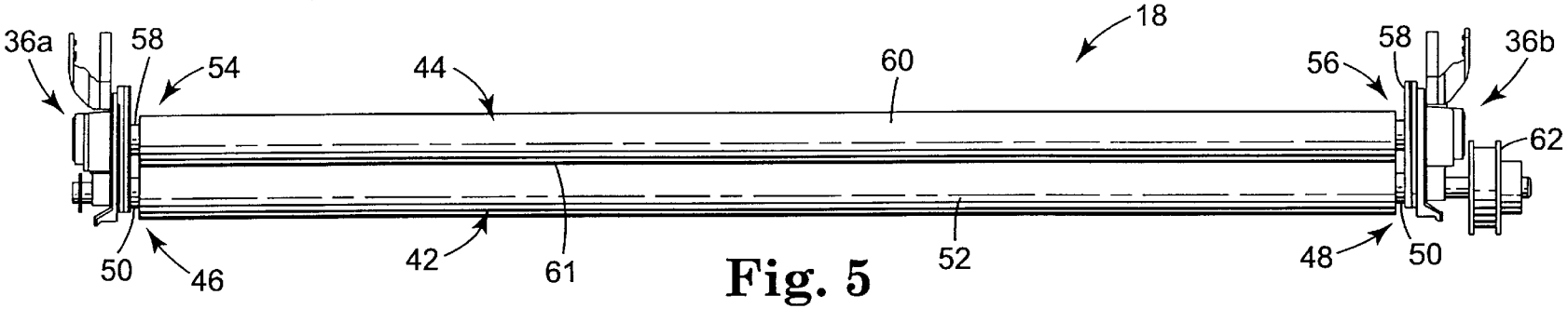
FIG. 5 is a view of the film roller assembly viewed along the film transport path with the rollers biased against each other to form a nip for transporting a piece of photosensitive film.

The film transport roller assembly 18 is configured as a nip roller assembly. In the exemplary embodiment shown, the film transport roller assembly 18 includes a first, or drive roller 42 and a second, or pinch roller 44. Referring to FIG. 5, in one exemplary embodiment, drive roller 42 is a generally elongate member having a first end 46, a second end 48, and a shaft 50 extending longitudinally therethrough. Shaft 50 is covered with a film engaging surface 52. Similarly, pinch roller 44 is a generally elongate member having a first end 54, a second end 56, and a shaft 58 extending longitudinally therethrough. Shaft 58 is covered with a film engaging surface 60. As shown in FIG. 5, bearing block assembly 36*a* and bearing block assembly 36*b* retain drive roller 42 and pinch roller 44 in a nip position for receipt and movement of a piece of photosensitive film therebetween, indicated at 61, while obstructing the passage of light therethrough.

Figure 6:
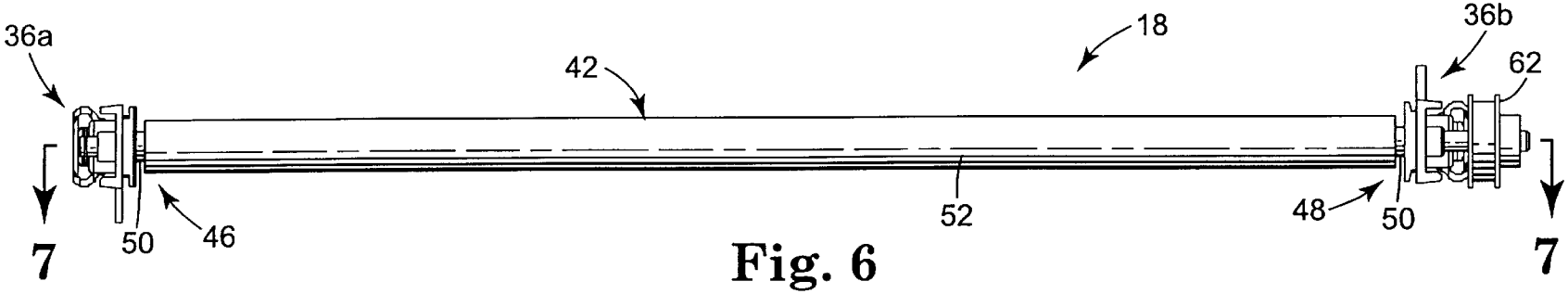
FIG. 6 is a side view of a pair of rollers mounted in a bearing block assembly.
Figure 7:
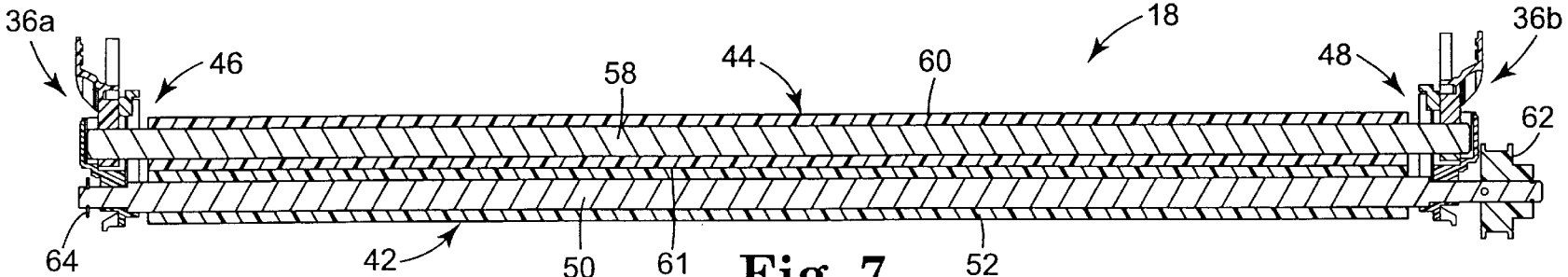
FIG. 7 is a cross-sectional view of the rollers and bearing block assembly taken along line 7—7 of FIG. 6.

Referring also to FIG. 6 and FIG. 7, drive roller 42 is mechanically coupled to pulley mechanism 62. In particular, at first end 46, the shaft 50 is rotatably coupled to bearing block assembly 36*a*. Pin mechanism 64 maintains the shaft 50 extending through bearing block assembly 36*a*. At second end 48, shaft 50 extends through bearing block assembly 36*b* (and is rotatable with respect to bearing block assembly 36*b*), and is fixedly coupled to pulley mechanism 62. The pinch roller shaft 58 is rotatably coupled to bearing block assembly 36*a* at first end 46, and similarly, the pinch roller shaft 58 is rotatably coupled to bearing block assembly 36*b* at second end 48.

In one preferred embodiment, the drive roller shaft 50 and pinch roller shaft 58 are precision made of stainless steel, having a diameter of 9.53 mm and a length of approximately 460 mm. Film engaging surfaces 52, 60 are made of a polymeric or elastomeric material (e.g., an elastomeric urethane). One suitable polymeric material for film engaging surfaces 47, 48 is the elastomer polyurethane, having a hardness of 50 durometer shore A. Drive roller shaft 50 and pinch roller shaft 58 have an outside diameter of 16.72 mm, and film engaging surfaces 52, 60 have a thickness of 7.19 mm.

As a piece of photosensitive film is moved along the film transport path, a static charge may build up on the film surface. In order to avoid possible damage to an image located on the photosensitive film due to the build up of static charge, drive roller 42 and pinch roller 44 are static dissipating rollers (as opposed to a conventional conductive roller). As such, as a piece of photosensitive film having charge build up on the surface thereof passes through the nip roller assembly of drive roller 42 and pinch roller 44, the rollers 42, 44 provide a path to ground for the static discharge. In particular, an additive is utilized in the film engaging surfaces 52, 60 (e.g., elastomeric urethane with a permanent antistatic additive contained therein) to cause the film engaging surfaces 52, 60 to be sufficiently conductive as to provide a static electricity dissipating path from the film engaging surfaces 52, 60 to their respective conductive shafts 50, 58. Selection of an antistatic or static dissipating additive compatible to the chemistry of the film used in the imaging processing system is important in order to prevent the rollers from applying an undesired artifact to the film, or "snagging" of the film as it slides on the roller surface. In one preferred embodiment, the film engaging surfaces 52, 60 are made of a 50 durometer polyurethane having a static dissipating additive contained therein, providing a resistivity range between 9×10 E7 to 4×10 E8 Ohm-Cm. In one embodiment, the static dissipating additive is quaternary ammonium ethosulphate. It is recognized that other static dissipating additives may be used, such as carbon black, other static dissipating additives may be desirable based on the chemistry of the film. The static electricity dissipation path follows the conductive shafts 50, 58 through bearing block assemblies 36*a*, 36*b* (which also contain a static dissipation additive as will be described later in the specification) to the imaging system housing 16 frame, which is made of sheet metal and coupled to the ground.

Figure 8:
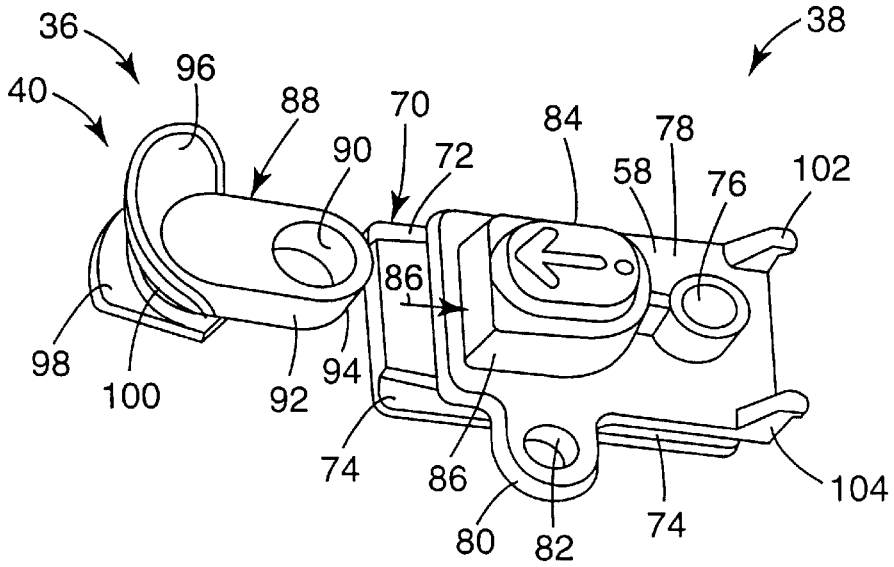
FIG. 8 is a perspective view of a bearing block assembly in accordance with the present invention with the bearing slide member slid out of the slide track in the bearing block.

Referring to FIG. 8, a perspective view of a bearing block assembly in accordance with the present invention is generally shown which can be similar to bearing block assemblies 36*a*, 36*b* as shown herein. As previously described herein, bearing block assembly 36 includes bearing block 38 and bearing slide member 40. In one embodiment, bearing block 38 and bearing slide member 40 are both constructed from a polymeric material or similar material having sufficiently low friction coefficients and suitable hardness which allows their use as bearings without the need for the use of separate bearing members. Further, a static dissipating additive is added to the polymeric material to make the bearing block assemblies static dissipating to provide a path to ground for any static charge present on the surface of a piece of film similar to film engaging surfaces 52, 60, as previously described herein. One polymeric material suitable for use as a bearing block assembly for a film transport roller assembly in accordance with the present invention having a antistatic or static dissipating additive contained therein is an acetal polymer with a permanent antistatic additive contained therein, which exhibits very good wear/abrasion resistance and having a high shrink rate. One suitable acetal polymer having an antistatic additive contained therein is commercially available under the tradename PERMASTAT 800. Further, other materials such as polytetrafluoroethylene may be added to the acetal polymer blend material. Other known suitable materials for use in forming a bearing block assembly in accordance with the present invention include polycarbonate or acrylic having a permanent antistatic additive contained therein. Additionally, known polymers such as polycarbonate or acetal may be blended with carbon black or a stainless steel fiber and/or polytetrafluoroethylene to achieve the results of a suitably hard bearing assembly having sufficiently low friction coefficients and static dissipating properties, although it is recognized that use of stainless steel or other metal fibers may "snag" certain thin films coming in contact therewith.

Bearing block 38 includes side channel mechanism 70 having a first channel 72 and a second channel 74. The channel assemblies 72, 74 are arranged and constructed for removable engagement with the edge perimeter of mounting slots 32, 34 such that the bearing block assembly may be removably mounted within mounting slot 32, 34 on imaging system 10.

Bearing block 38 includes a shaft receiving aperture 76 extending through its face 78. The shaft receiving aperture 76 is sized for slidable receipt of a roller shaft, such as pinch roller shaft 58.

A mounting tab 80 on bearing block 38 has a hole 82 passing therethrough which can be aligned with a corresponding hole in plate 26 or 28 to permit the roller assembly to be secured in place with mounting screws after the bearing block assemblies 36*a*, 36*b* are slid into mounting slots 32, 34 when initially installed.

Bearing block 38 includes a bearing block housing 84 having an opening which defines a bearing slide receiving area 86. Bearing slide member 40 includes a shaft supporting member 88 having an aperture 90 passing therethrough. In one embodiment, shaft supporting member 88 includes a rounded edge 94 and is sized for slidable receipt into bearing slide receiving area 86. As can also be seen in FIG. 7, when bearing slide member 40 is positioned such that shaft supporting member 88 is inserted within bearing slide receiving area 86, it is properly oriented to receive an end (54, 56) of pinch roller 44 through an opening in the rear face of bearing block 38 and aperture 90.

Bearing slide member 40 further includes thumb tab 96 and extension tab 98, which extend outward from bearing slide member 40. Thumb tab 96 and extension tab 98 aid in gripping the bearing slide member 40 for moving the bearing slide member 40 relative to the bearing block 38, resulting in a subsequent movement of drive roller 42 away from pinch roller 44. Further, thumb tab 96 and extension tab 98 define side walls of a biasing mechanism routing channel 100. Bearing block 38 further includes post 102 and post 104. In one embodiment, biasing mechanism 41 is a spring 106 (shown in FIG. 4). The spring 106 has its ends secured at post 102 and post 104, which extend from bearing block face 78. In particular, spring 106 is routed from post 102 around the perimeter of bearing slide member 40 through biasing mechanism routing channel 100, having opposite ends secured at post 104. The compression force of spring 106 urges bearing slide 40 into bearing slide receiving area 86, and in turn, biases pinch roller 44 against drive roller 42. Positive stops on the movement of bearing slide member 40 protect against excessive motion of the pinch roller 42 in either direction and are provided by the mechanical interfacing of bearing slide member 40 and bearing block 38.

Figure 9:
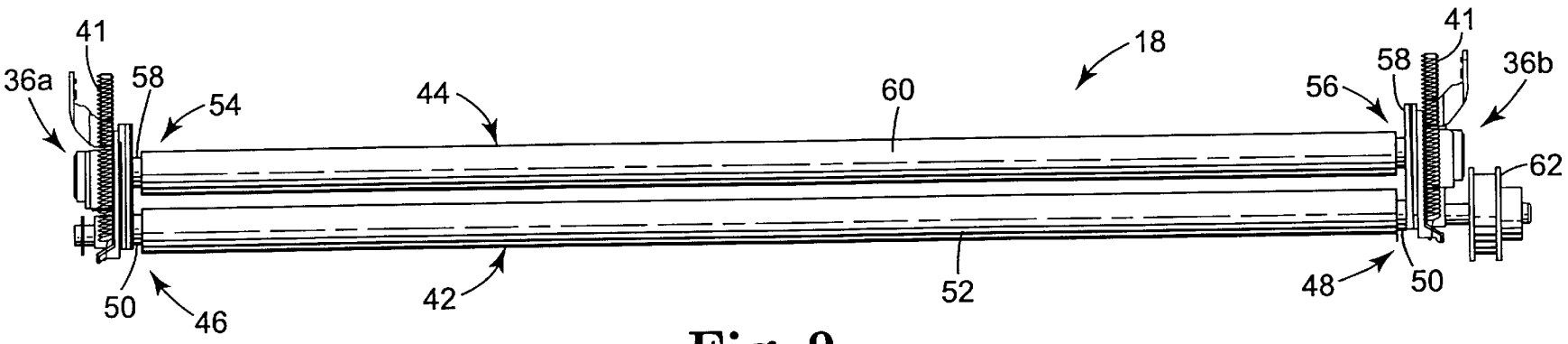
FIG. 9 is a view of the film roller assembly as in FIG. 5 with the rollers separated to permit the clearing of jammed piece of film or for performing maintenance thereon.

Referring to FIG. 9, film transport roller assembly 18 is shown in a film clearing or film jam removal position. As such, thumb tab 96 and extension tab 98 may be grasped and pulled, moving bearing slide member 40 away from slider block 38, allowing pinch roller 44 to be pulled away from drive roller 42 to allow an operator to easily remove a piece of film which may be jammed between the rollers 42, 44 without requiring removal of the film transport roller assembly 24.

The film roller assembly in accordance with the present invention may be installed within an imaging system between two rigid plates as a preassembled assembly and does not require movement of the plate or removal of their respective bearing sets for installation or maintenance. Further, the novel molded slider block assemblies in accordance with the present invention allow the drive roller to be moved relative to the pinch roller, allowing access to the roller assembly for maintenance or for the clearing of film jams. Further, the unique film roller assembly in accordance with the present invention manages static electricity buildup on transported sheet material by providing static electricity dissipation characteristics such that the static electricity is dissipated from the surface of the film to the frame of the imaging system.

Having described the exemplary embodiments of the invention, additional advantages and modifications will readily occur to those skilled in the art from consideration of the specification and practice of the invention disclosed herein. Therefore, the specification and examples should be considered exemplary only, with the true scope and spirit of the invention being indicated by the following claims.

What is claimed is:

1. A film transport roller assembly for use in a laser imaging system for transporting a piece of photosensitive film along a film transport path, the film transport roller assembly comprising:

a first and second bearing block assembly each configured to be removably mounted to a frame;

a first roller; and a second roller;

wherein the first roller and second roller are rotatably coupled in a nip position between the first and second bearing block assembly, and wherein the first and second bearing block assembly each comprise a slider block; a bearing block, wherein the bearing block includes a slider block receiving aperture, and wherein the slider block is slidably positioned within the bearing block; and a biasing mechanism coupled between the slider block and the bearing block which biases the slider block against the bearing block.

2. The assembly of claim 1, wherein each bearing block assembly further comprises a gripping mechanism extending from the slider block to aid an operator in gripping the slider block and moving the slider block in a direction away from the bearing block.

3. The assembly of claim 2, wherein the gripping mechanism includes a thumb tab and an extension tab.

4. The assembly of claim 2, wherein the gripping mechanism defines a biasing mechanism channel.

5. The assembly of claim 1, wherein the film transport roller assembly further comprises a pair of mounting channels configured to allow the bearing block assembly to be slidably received within an imaging system frame.

6. The assembly of claim 1, wherein the film transport roller assembly further comprises a biasing mechanism mounting post, and wherein the slider block defines a biasing mechanism mounting channel.

7. The assembly of claim 6, wherein the biasing mechanism mounting channel extends at least partially along an outside perimeter of the slider block.

8. The assembly of claim 1, wherein the first roller is rotatably mounted to the slider blocks, and wherein the second roller is rotatably mounted to the bearing blocks.

9. The assembly of claim 1, wherein at least one of the first and second bearing block assembly further comprises a stop mechanism for limiting the degree of movement between the slider block and the bearing block.

10. The assembly of claim 1, wherein at least one of the first and second bearing block assembly is made of a polymeric material.

11. The assembly of claim 1, wherein at least one of the first and second bearing block assembly is made of a material sufficiently conductive to allow the dissipation of static electricity therethrough.

12. The assembly of claim 1, wherein at least one of the first and second bearing block assembly is made of a polymeric material having a static dissipation additive mixed therein.

13. The assembly of claim 1, wherein at least one of the first and second bearing block assembly is made of an acetal resin-based material.

14. The assembly of claim 1, wherein the first roller or the second roller is made of a material sufficiently conductive to allow the dissipation of static electricity therethrough.

15. The assembly of claim 1, wherein the first roller and the second roller each comprise a generally elongate metallic shaft having a film engaging coating thereon.

16. The assembly of claim 15, wherein the metallic shaft is stainless steel.

17. The assembly of claim 15, wherein the film engaging coating is made of a polymeric material.

18. The assembly of claim 17, wherein the polymeric material is an elastomeric urethane.

19. The assembly of claim 17, wherein the polymeric material includes a static dissipating additive.

20. The assembly of claim 19, wherein the static dissipating additive is quaternary ammonium ethosulphate.

21. The assembly of claim 19, wherein the static dissipating additive is carbon black.

22. The assembly of claim 1, wherein the first roller and the second roller are static dissipating rollers, and wherein each bearing block assembly is made of a static dissipating material, including a polymeric material having a static dissipating additive contained therein.

23. A film transport assembly for installation in an imaging system including a pair of rigid plates each forming a mounting slot, the invention comprising:

a first and second roller each having a film engaging surface covering a central roller portion thereof and shaft portions extending from both ends of the central roller portion;

a pair of bearing slide members each having a shaft receiving aperture, rotatably maintaining a respective one of the shaft portions of the second roller, surrounded by a shaft supporting surface;

a pair of bearing blocks each including:

a shaft receiving aperture rotatably maintaining a respective one of the shaft portions of the first roller, a shaft supporting surface surrounding the shaft receiving aperture, a bearing slide engaging area adjacent the aperture, a circumferential slot projecting into walls thereof and arranged for releasable engagement with the mounting slot in one of the pair of rigid plates for securing the bearing block to the rigid plate;

wherein each of the pair of bearing slide members is movably positioned on the bearing slide engaging surface of a respective one of the pair of bearing blocks such that movement of the pair of bearing slide members toward a first position relative to the pair of bearing blocks, respectively, disengages the film engaging surface of the second roller from the film engaging surface of the first roller and movement of the pair of bearing slide members away from the first position causes the film engaging surface of the second roller to contact the film engaging surface of the first roller; and spring means operatively connected between one of the bearing slide members and a respective one of the bearing blocks for biasing the film engaging surface of the second roller into film transporting contact with the first roller.

24. The invention of claim 23, wherein each of the bearing blocks includes a slide track for slidably receiving the bearing slide member so that the movement of the bearing slide member along the slide track toward and away from the first position occurs without axial movement between the bearing slide member on the bearing block.

25. The invention of claim 24, wherein each of the slide tracks includes at least one motion stop to restrain movement of the respective bearing slide member along the slide track relative to the respective bearing block beyond the amount necessary to allow separation of the first and second rollers to permit jammed film to be removed from the nip of the first and second rollers.

26. The invention of claim 25, wherein each of the bearing blocks includes a cover member covering the bearing slide receiving area and a projecting end of a respective one of the shaft portions of the second roller while allowing slidable movement of the bearing slide member along the slide track to move the second roller relative to the first roller thereby assuring a light tight seal from the outside of the rigid plates to the film transport path between the rigid plates.

27. The invention of claim 23, wherein the film engaging surface of at least one of the first and second rollers is urethane.

28. The invention of claim 27, wherein the film engaging surface includes a material which renders the roller sufficiently conductive so as to provide a static electricity dissipation path from the surface of the film engaging surface to the roller shaft.

29. The invention of claim 23, wherein the material of each of the bearing blocks and the bearing slide members is an acetal resin-based polymer material.

30. The invention of claim 29, wherein the polymer material of each of the bearing blocks and the bearing slide members is configured to provide static electricity dissipation between at least one of the first and second rollers and the rigid plates upon which the transport roller assembly is mounted without degrading the mechanical properties of the roller or causing the film engaging surface of the roller to apply image artifacts to film as it is being transported.

31. The invention of claim 23, wherein the spring means is an extension spring having both ends thereof anchored to the bearing block with the body of the spring engaging the bearing slide member.

32. The invention of claim 31, wherein each of the bearing blocks is provided with at least one projecting spring post for securing the ends of the spring means.

33. The invention of claim 31, wherein the bearing slide member includes a projecting lip positioned for engagement by the spring means to bias the second roller into film engaging contact with the first roller.

34. A static dissipating film transport roller assembly for use in a laser imaging system for transporting a piece of photosensitive film along a film transport path, wherein as the film is transported along the film transport path static electricity may tend to build up on a surface thereof, the static dissipating film transport roller assembly comprising:

a first and second bearing block assembly configured to be removably mounted to a frame and each made of a polymeric material having a static dissipating additive contained therein; and a first roller and a second roller, wherein the first roller and the second roller each include an elongated metallic shaft having a film engaging coating thereon, the film engaging coating made of a polymeric material having a static dissipating additive contained therein;

wherein the first roller and the second roller are rotatably coupled in a nip position between the first and second bearing block assemblies.

* * * * *